US005853102A

United States Patent [19]

Jarrett

[11] Patent Number: 5,853,102

[45] Date of Patent: Dec. 29, 1998

[54] INSERT FOR SPRAY GUN PAINT CUPS

[76] Inventor: Guy R. Jarrett, 1905 Winning Ave., Modesto, Calif. 95350

[21] Appl. No.: 789,651

[22] Filed: Jan. 27, 1997

[51] Int. Cl.[6] ..... B65D 25/00

[52] U.S. Cl. ..... 220/410; 220/408

[58] Field of Search ..... 220/470, 408, 220/410, 400, 570

[56] References Cited

U.S. PATENT DOCUMENTS

| | | | |
|---|---|---|---|
| 3,978,232 | 8/1976 | Dodsworth et al. | 220/410 X |
| 4,122,973 | 10/1978 | Ahern | 220/410 X |
| 4,555,339 | 11/1985 | Graves | 220/410 X |
| 4,756,046 | 7/1988 | Surface | 220/408 X |
| 5,167,929 | 12/1992 | Korf et al. | 220/410 X |
| 5,236,102 | 8/1993 | Quittmann et al. | 220/408 X |

*Primary Examiner*—Steven M. Pollard

[57] ABSTRACT

An oblique frustro-conical hollow insert for placement within a paint cup of a siphon spray gun to restrict and reduce an internal area surrounding an intake hole of a vacuum tube of said spray gun so that the insert itself, and not the paint cup may be filled with a small volume of paint for spray painting a small surface area.

3 Claims, 3 Drawing Sheets

INSERT FOR SPRAY GUN PAINT CUPS

BACKGROUND OF THE INVENTION

1. Field of the Invention

This invention deals with paint reservoirs or containers, commonly known as paint cups, which are attached to spray guns for applying liquid coatings onto a surface.

More particularly, the present invention pertains to an oblique frustro-conical hollow insert for placement within said paint cup to restrict and reduce an internal area surrounding a siphon tube of said spray gun so that the insert itself, and not the cup may be filled with a much smaller volume of paint for painting a small surface area.

2. Discussion of the Prior Art

As it is perhaps well known, painting by spray gun is a common technique used today for a variety of painting operations. However, in automotive-body repair there are problems with using traditional spray guns because they utilize paint cups with internal areas which require a relatively large volume of paint for efficient operation of the gun even though the area to be painted may be small.

For example, a minor automobile collision resulting in a damaged fender may require after repair only a few ounces of paint, but traditional spray guns require much more paint in their cups to work properly which results in waste and needless expense.

As those skilled in the art probably know, automobile paint is expensive and its color is difficult to match. It would be an ideal situation if a painter could merely obtain a correctly colored paint from a manufacturer, however with automobiles, as with most other surface structures, their surface paint tends to undergo color change with time, and, therefore, there is a need in most painting operations to mix and match paints to obtain a proper color.

Once the color is matched and applied, a small amount of the paint is saved and usually refrigerated to extend its shelf life in the event that the repaired area need to be repainted, rather than mixing and matching another quantity of paint for proper operation of a spray gun and thereby resulting in needless waste and expense.

Therefore it is an object of the present invention to provide an insert for placement into a paint cup to reduce its internal area so that a small volume of paint, such as that saved for repainting, need only be required for proper operation of a spray gun. This object is achieved in the present invention.

SUMMARY OF THE INVENTION

In accordance with the present invention, an oblique frusto-conical hollow insert is provided for placement into a spray gun cup so that said insert, rather than the cup, may be filled with a relatively small volume of paint. The insert, being frustro-conically oblique, surrounds a siphon tube of a spray gun more narrowly at the intake at the base of said tube so as to continuously provide a supply of paint from the insert by gravity without introduction of air regardless of the angle the spray gun is held.

DETAILED DESCRIPTION OF THE PREFERRED EMBODIMENT

Before turning to the drawings, it should be mentioned that there are two basic types of spray guns used in a paint shop. These are known as the pressure pot gun and the siphon gun. Either gun does the same job as it turns the liquid paint into a spray of droplets by using air pressure.

A pressure pot spray gun works on compressed air and paint is supplied from a pot. Air pressure forces the paint from the pot, out through a paint hose and then into the spray gun head. When it leaves the nozzle, the liquid paint is mixed with air, atomizing the paint into a fine spray. However pressure pot spray guns are not widely used in the body shop trade because they weigh more than siphon guns and are harder to move around.

A siphon gun works on a vacuum (suction) system, and for this reason siphon guns are also known as suction guns. In a siphon gun, air rushes through an air nozzle, creating a suction in a vacuum tube located within an attached paint cup thereby pulling paint from the cup into the paint gun. Here, liquid is sucked out the nozzle tip by compressed air leaving the tip which results in a spray of tiny liquid paint droplets.

One problem with a siphon gun is that its normal one quart paint cup needs sufficient volume of paint for proper operation, because if paint does not continuously surround the intake portion of the vacuum tube, air will enter the gun and cause the paint to spurt, rather than spray onto a surface. Therefore, it is common practice in an automotive paint shop to fill a paint cup with far more paint than is required to do a job and this practice results in unnecessary expense, waste and disposal problems.

To remedy this situation, the oblique frustro-conical hollow insert herein described is presented. It may be constructed of plastic by a common technique of injection molding, but other suitable materials such as metal or paper may also be used. It may also be manufactured in various sizes to accommodate different size paint cups.

Figure 1:
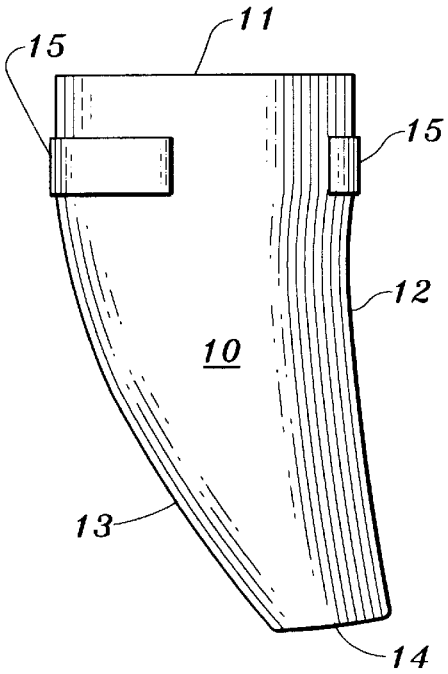
FIG. 1 is a side elevational view of the insert of the present invention.
Figure 2:
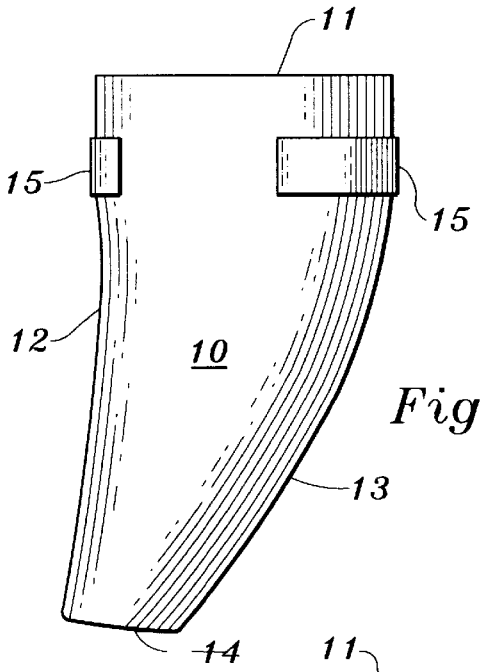
FIG. 2 is the opposite side of that shown in FIG. 1.

Now, turning to the drawings, FIGS. 1 & 2 are side elevational views of the insert 10 of the present invention having an open top portion 11, a front surface area 12, a rear surface area 13, and a solid bottom surface 14. Preferably, there are bumper elements 15 attached near the top of the insert in order to position it centrally in a paint cup (see FIG. 6).

Figure 3:
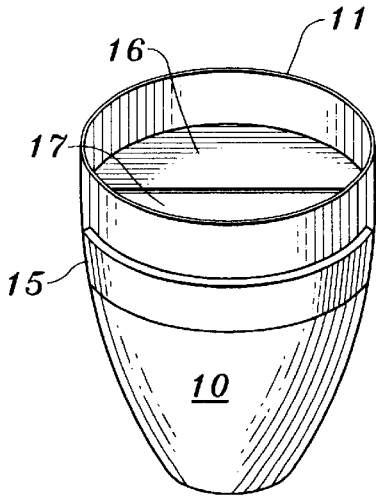
FIG. 3 is a top and rear perspective view of the insert.

FIG. 3, a rear and top perspective view of the insert 10 shows a horizontal semi-circular shelf 16 located in the opening 17 for the purpose of providing a dam to prevent paint from spilling into the paint cup when the spray gun is tilted forward.

Figure 4:
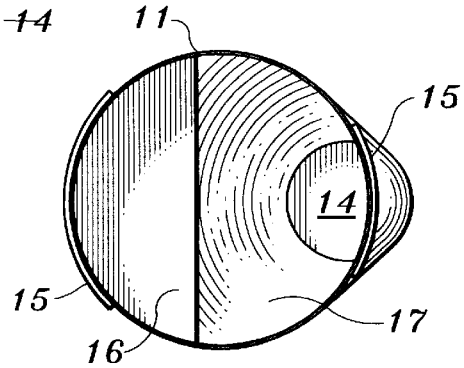
FIG. 4 is a top plan view of the insert.

The position of the shelf 16 is better illustrated in FIG. 4, a top plan view of said insert.

Figure 5:
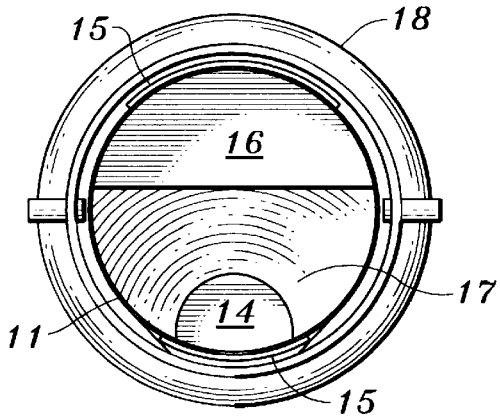
FIG. 5 illustrated the insert being placed into a paint cup.
Figure 6:
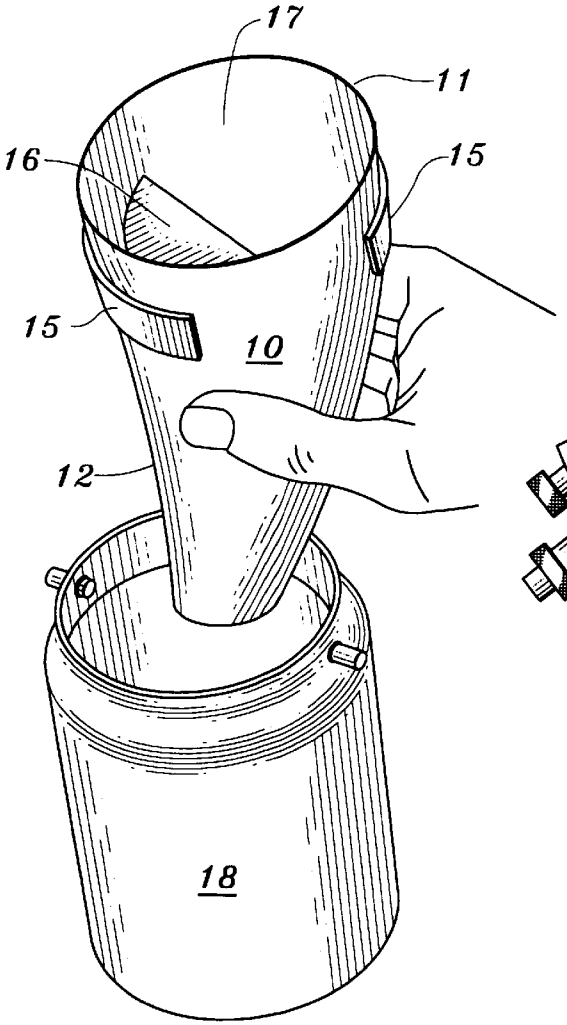
FIG. 6 is a top plan view of the insert positioned in a paint cup.

FIG. 5 is a top, side, and front perspective view of the insert 10 of the present invention being placed into a standard one quart paint cup 18 for a siphon spray gun and FIG. 6 is a top plan view of said insert in said paint cup 18.

Figure 7:
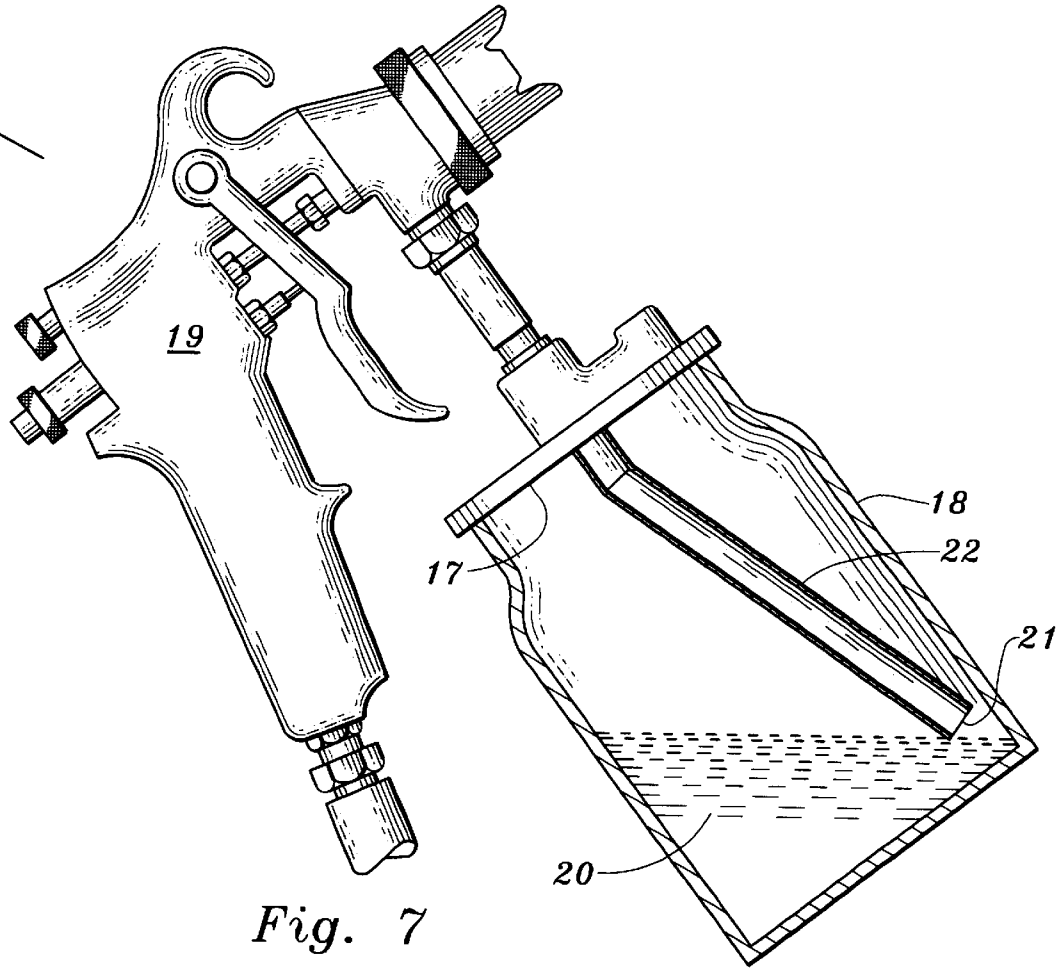
FIG. 7 is a cross-sectional view of a typical paint cup without the insert showing the attached spray gun held upward at a 45 degree angle.

To illustrate the present problem experienced with a standard suction spray gun 19, FIG. 7 shows a cut away view of a common one quart paint cup 18 without the insert of the present invention installed. There, illustrated in broken lines is about one pint of paint 20. It can be easily seen that when the gun 19 is tilted upwardly at about a forty-five degree angle, the paint 20 does not engage an intake hole 21 of a vacuum tube 22, thereby allowing air from the interior of the cup 18 to enter the gun 19, which causes spurting, rather than spraying of paint.

Even is the gun 19 of FIG. 7 were held horizontally, it can be easily imagined that back and forth movement of said gun while painting would cause a small quantity of paint in the cup to also move from side to side resulting in the same problem.

Figure 8:
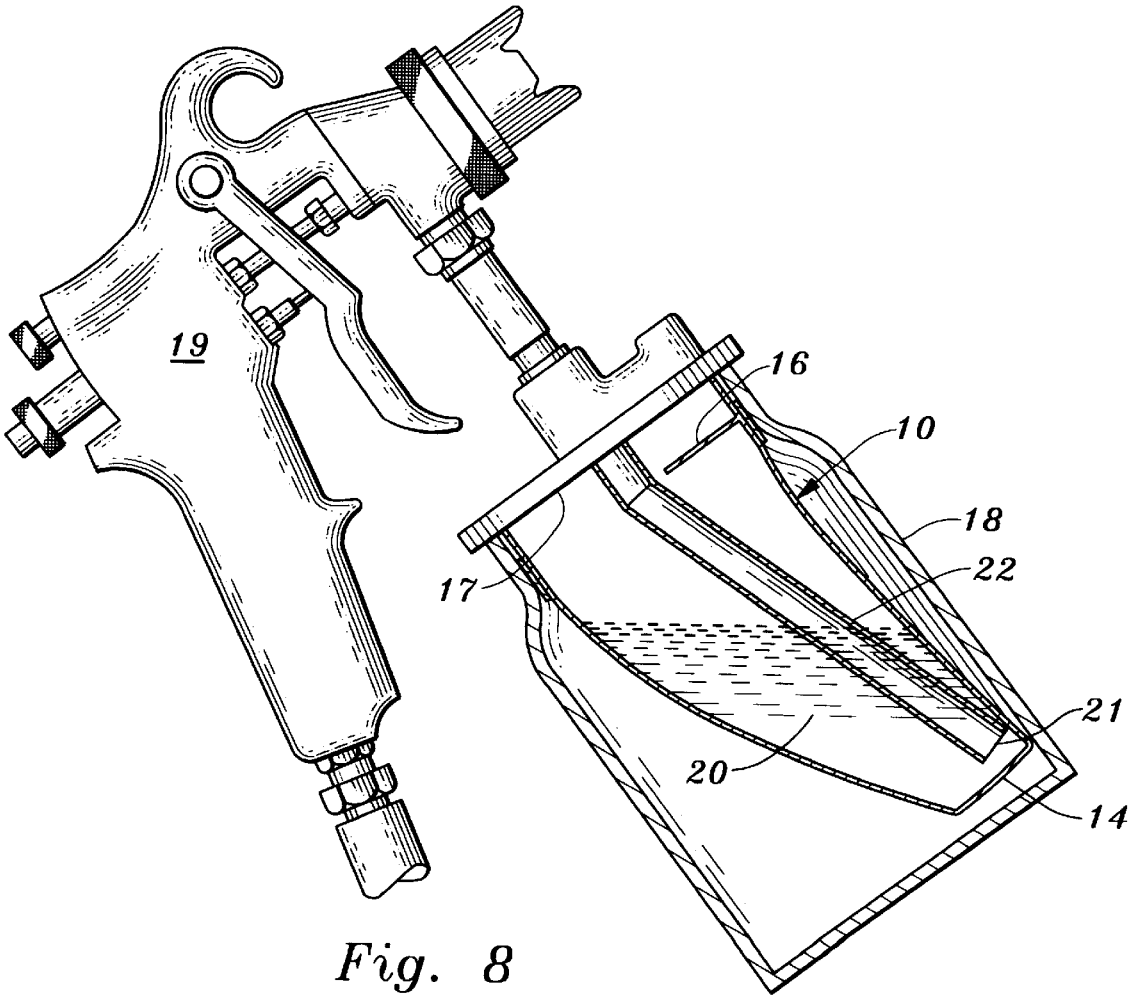
FIG. 8 is the same spray gun as shown in FIG. 7, but with the insert installed.

FIG. 8 is the same illustration as FIG. 7, but with the insert 10 of the present invention installed. It can be seen that the same volume of paint 20 contained in the insert 10 alone provides continuous paint supply to the intake hole 21 of the vacuum tube 22, regardless of the angle the gun 19 is held or in the manner in which it is moved.

Having described my invention in detail, I claim:

1. An oblique frustro-conical hollow insert for placement within a paint cup of a siphon spray gun to restrict and reduce an internal area surrounding an intake hole of a vacuum tube of said spray gun so that the insert itself, and not the paint cup may be filled with a small volume of paint for spray painting a small surface area, said insert having an open top and a closed bottom, said open top being larger than said closed bottom, and said open top and said closed bottom each having a centerline, said center lines being offset each from the other.

2. The insert of claim 1 wherein its opening there is a semi-circular shelf to provide a dam for containing paint the the insert when the spray gun is tilted forward.

3. The insert of claim 1 whereby it is constructed of plastic.

* * * * *